US005882284A

United States Patent [19]

Cayne

[11] Patent Number: 5,882,284

[45] Date of Patent: Mar. 16, 1999

[54] ABDOMINAL EXERCISING APPARATUS

[75] Inventor: Jaeson D. Cayne, Carlsbad, Calif.

[73] Assignee: Marson Gold, Inc., Del Mar, Calif.

[21] Appl. No.: 800,112

[22] Filed: Feb. 13, 1997

Related U.S. Application Data

[63] Continuation-in-part of Ser. No. 607,616, Feb. 27, 1996.

[51] Int. Cl.[6] ..... A63B 21/02

[52] U.S. Cl. ..... 482/130; 482/140; 482/123; 482/142

[58] Field of Search ..... 482/121, 122, 482/123, 129, 130, 140, 142, 124

[56] References Cited

U.S. PATENT DOCUMENTS

| | | | |
|---|---|---|---|
| 4,198,044 | 4/1980 | Holappa . | |
| 4,403,773 | 9/1983 | Swann . | |
| 4,606,539 | 8/1986 | Farnham . | |
| 5,100,131 | 3/1992 | Fong | 482/134 |
| 5,299,998 | 4/1994 | Hutchins | 482/135 |
| 5,407,411 | 4/1995 | Trainor | 482/124 |
| 5,492,520 | 2/1996 | Brown . | |
| 5,512,029 | 4/1996 | Barbard et al. | 482/124 |
| 5,545,114 | 8/1996 | Gvoich | 482/140 |
| 5,616,109 | 4/1997 | Szu-Ming | 482/130 |

*Primary Examiner*—Lynne A. Reichard
*Attorney, Agent, or Firm*—Christie, Parker & Hale, LLP

[57] ABSTRACT

An abdominal exercise apparatus comprising a platform having two upwardly extending sidewalls. Positioned between the sidewalls and over the platform is an adjustable belt including an abdominal pad. The belt is connected to the platform by elastic cords which extend from either side of the belt through the sidewalls and attach underneath the platform on a series of hooks. In use, the belt is tightened across the abdomen of a user so that as the user rotates forward in a "sit-up" or "crunch" type exercise, the abdominal pad and elastic cords provide direct resistance to the abdomen for an isometric and kinetic abdominal exercise.

20 Claims, 9 Drawing Sheets

22
10
20
42
44
56
40
46
58
24
26
48
18
38
16
54
36
35
30
32
12
28

60
64
62
68

ABDOMINAL EXERCISING APPARATUS

CROSS REFERENCE TO RELATED APPLICATION

This is a continuation in part of Ser. No. 08/607,616 filed Feb. 27, 1996, entitled "Combination Abdominal Exercising Apparatus."

FIELD OF THE INVENTION

This invention relates to the increasingly popular field of body development and exercise activity for the purpose to increase tone, size, and definition of abdominal and gluteus muscles, and more particularly to an abdominal exercising apparatus which provides both an isometric and kinetic exercise.

BACKGROUND OF THE INVENTION

It is well-known that the abdominal and gluteus muscles are difficult to isolate and strengthen. Many hours and years of exercise are generally necessary to produce a significant effect on the abdominal musculature. An extremely effective prior art device for strengthening of the abdominal musculature without placing unnecessary stress upon the lower back is disclosed in U.S. Pat. No. 5,160,304, issued to the inventor of the present invention. The device described in the '304 patent is known as the "Abflex" and has enjoyed wide spread commercial success. The Abflex provides for an isometric contraction process of the abdominal musculature which necessarily precludes excessive lumbar movement. The subject pulls with both hands on a pair of handles and simultaneously contracts the abdominal musculature, thereby moving the abdomen against a tensioned member.

Although the Abflex is highly effective, there is a need for a kinetic exercise to supplement the isometric exercise provided by the Abflex. Many exercise devices exist which allow a user to exercise his or her abdomen through rotation of the user's upper body, the exercise is known as a "crunch" type exercise. Prior art "crunch" type devices, however, have a number of shortcomings. For example, the user of the device has too much freedom to move and may tend to "cheat" by moving his or her body so as to decrease the torque around the abdomen.

Further, these prior art devices do not exercise the abdomen in an isometric manner and therefore the benefits of the exercise provided by the Abflex are not obtained. Many exercisers wish to achieve a toned abdomen without devoting an undue amount of time to exercise but prior art devices do not allow such exercisers to combine different types of abdominal movements and/or contractions in one exercise, forcing the exercisers to either choose one or another type of exercise or spend more time exercising than is desired. There is therefore a need to provide an exercise device that effectively and simultaneously allows for different types of abdominal movements and/or contractions which provides both an isometric and kinetic exercise.

SUMMARY OF THE INVENTION

The present invention improves on prior art abdominal exerciser devices by combing the benefits of isometric exercises with the benefits of kinetic exercises. To achieve the benefits of both types of exercises, the present invention in a first embodiment comprises a structure which is rotatably coupled to a platform which receives a user. In this embodiment, the structure comprises two v-shaped members in parallel with one another and in a plane that is perpendicular to the platform. The c-shaped members are joined by a cross member.

The platform is coupled to a resistive structure, that comprises a post that is rigidly connected to and extends perpendicularly away from the platform. The post is coupled to a frame which in turn is coupled to a plunger. The plunger includes a pad section for providing contact with a user's abdomen. The plunger is configured to provide resistance against the user's abdomen.

In operation, a user places his or her back on the platform, grips the cross member, and rotates his or her upper body along with the rotating structure. As the user rotates forward, the plunger, through the pad provides direct resistance to the user's abdomen. The direct resistance provides an isometric abdominal exercise and also resists the user's rotation, which enhances the rotating or kinetic "crunch" type exercise.

In an alternative and preferred embodiment the abdominal exercise apparatus of the present invention comprises a platform having two upwardly extending side walls. Positioned between the side walls and over the platform is an adjustable belt including an abdominal pad. The belt is connected to the platform by elastic cords which extends from either side of the belt through the side walls and attach underneath the platform on a series of hooks.

In use, the user places their lower back on the platform such that the abdominal pad is adjacent the abdomen. The belt is tightened across the abdomen so that as the user rotates forward as in a "crunch" type exercise, the abdominal pad and elastic cords provide direct resistance to the abdomen. The resistance provides an isometric abdominal exercise while resisting the rise in the abdomen caused by the user's rotation.

The preferred embodiment preferably is used in combination with a "roller" type exercise device currently popular and on the market under a number of trademarks such as "ABROLLER." A typical roller type device is disclosed in U.S. Pat. No. 5,492,520 and comprises a frame defining a pair of support rails, a headrest, a pair of arcuate rocker portions, a pair of armrest portions and an upstanding arch-shaped portion connecting the support rails together. In use with a roller type device the abdominal exercise apparatus of the invention is positioned below the roller device between the support rails so that the abdominal pad and elastic cord provides resistance against the abdomen as the user rotates forward with the roller device. Again the resistance provides an isometric abdominal exercise while enhancing the kinetic exercise of the roller device.

These and other advantages will be more fully understood by reference to the following drawings and the detailed description.

DETAILED DESCRIPTION

Figure 1:
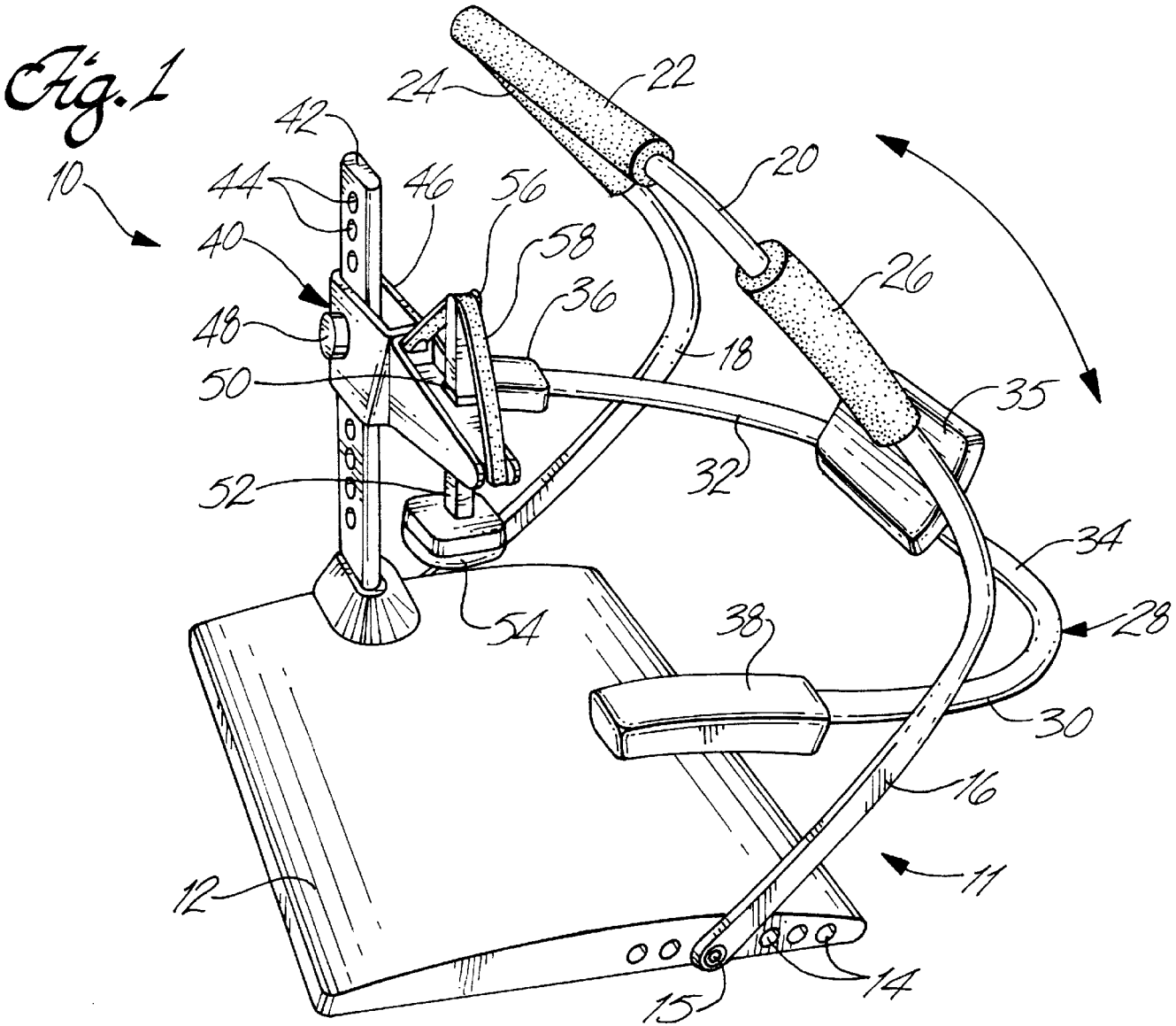
FIG. 1 is a perspective view of the abdominal exercise device in accordance with one embodiment of the present invention.

FIG. 1 is a perspective view of a first embodiment abdominal exercise device 10 of the present invention. As shown, a structure 11 is rotatably coupled to a platform 12, which includes a plurality of indexing holes 14 on either side of the platform 12 for positioning the structure 11. The structure 11 comprises two generally arcuate or c-shaped rigid members 16 and 18 in parallel with one another and in a plane that is perpendicular to the platform 12. The members 16 and 18 are generally in a 90° bend. Each of the c-shaped members 16 and 18 has a joint or pin 15 that fits into a particular hole 14, which may be selected by a user to adjust the exercise device to the body shape of the user. The c-shaped members 16 and 18 are joined by a rigid cross member 20 that includes a pad 22 for gripping by a user. The c-shaped members 16 and 18 and cross member 20 may be padded with tubular pads 24 and 26, as shown. The pads 22, 24 and 26 may be a foam rubber material for user comfort.

The structure 11 further includes a u-shaped member 28 with two side sections 30 and 32 and a back section 34. The side sections 30 and 32 are fixedly coupled to the c-shaped members 16 and 18 as shown such that the u-shaped member 28 is at an angle relative to the c-shaped members 16 and 18. The u-shaped member 28 has a head rest 35 for providing contact with the rear of an exerciser's head and the u-shaped member 28 includes two ends pads 36 and 38 made of a foam rubber, for example, for elbow and arm support.

Figure 2:
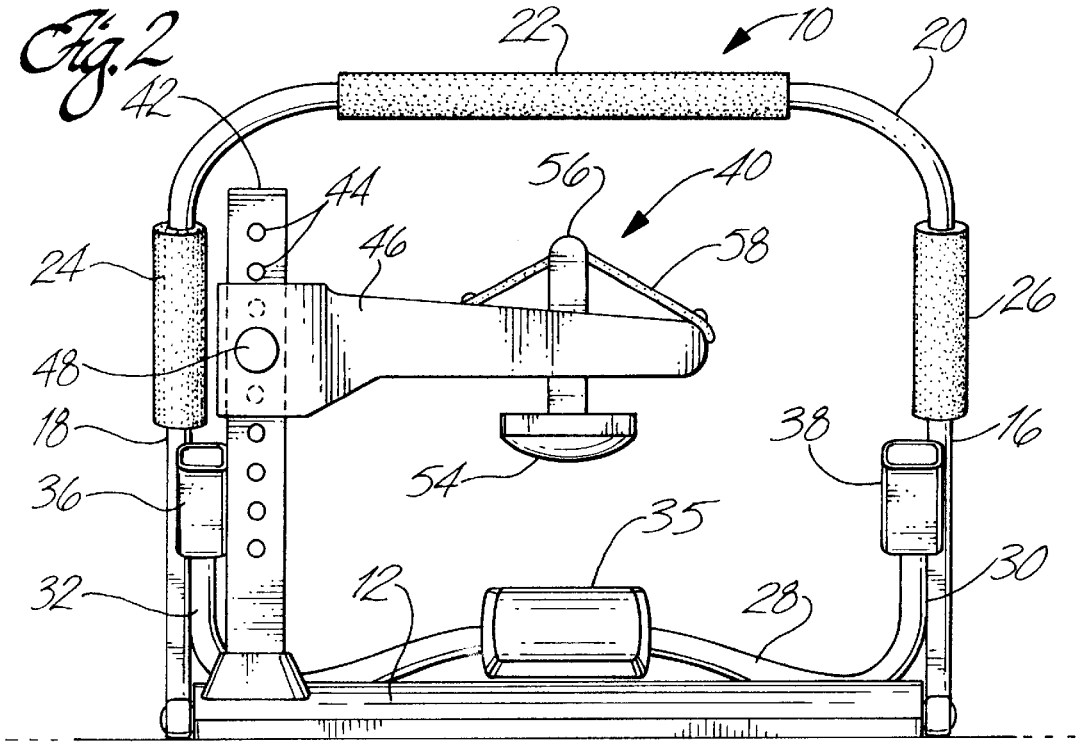
FIG. 2 is a front view of abdominal exercise device of FIG. 1.
Figure 3:
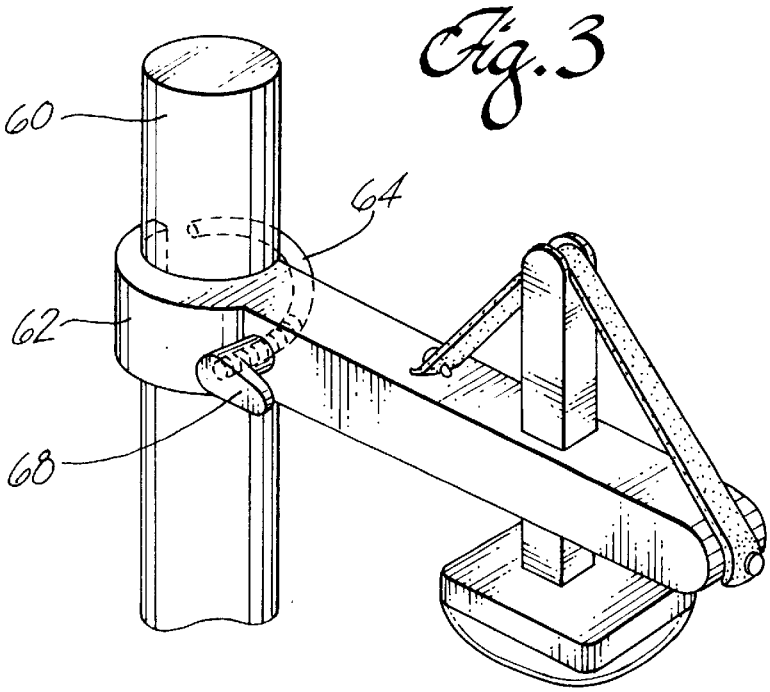
FIG. 3 illustrates an alternate post and plunger arrangement.

Still referring to FIG. 1, the platform 12 is rigidly coupled to a resistive structure 40 comprising a post 42 that extends perpendicularly from the platform 12. The post 42 comprises a plurality of indexing holes 44. A frame 46 is cantilevered from the post 42 and is attached to the post 42 at one of the holes 44 using a pin 48. The frame 46 in turn includes a vertical hole 50 to receive a plunger 52. The plunger includes a pad section 54 at one end for providing contact with a user's abdomen and a key 56 at another end for engaging an elastic band 58. The elastic band 58 is secured to opposite ends of the cantilevered section of the frame 46 and provides biasing force in the direction of the pad 54, so as to provide resistance against upward movement of the plunger 52. FIG. 2 is a front view of the post and plunger arrangement. FIG. 3 illustrates an alternative post and plunger arrangement comprising a pole 60 using a clamp 64. The frame 62 comprises a plunger assembly similar to the previous embodiment. The clamp 64 is tightened around the pole 60 by a screw knob 68, which may be loosened thereby allowing the frame 62, and the corresponding plunger assembly, to rotate about or translate along the pole 60 to be adjusted to a different position.

In this embodiment, the structural members comprise a unitary structure formed from a suitable material such as aluminum. The pads that came into contact with the user are padded which may be formed from a suitable material such as plastic or foam rubber for a comfortable contact. The abdominal pad 54 may be of the design disclosed in copending U.S. patent application Ser. No. 08/597,542 filed Feb. 2, 1996.

Figure 4A:
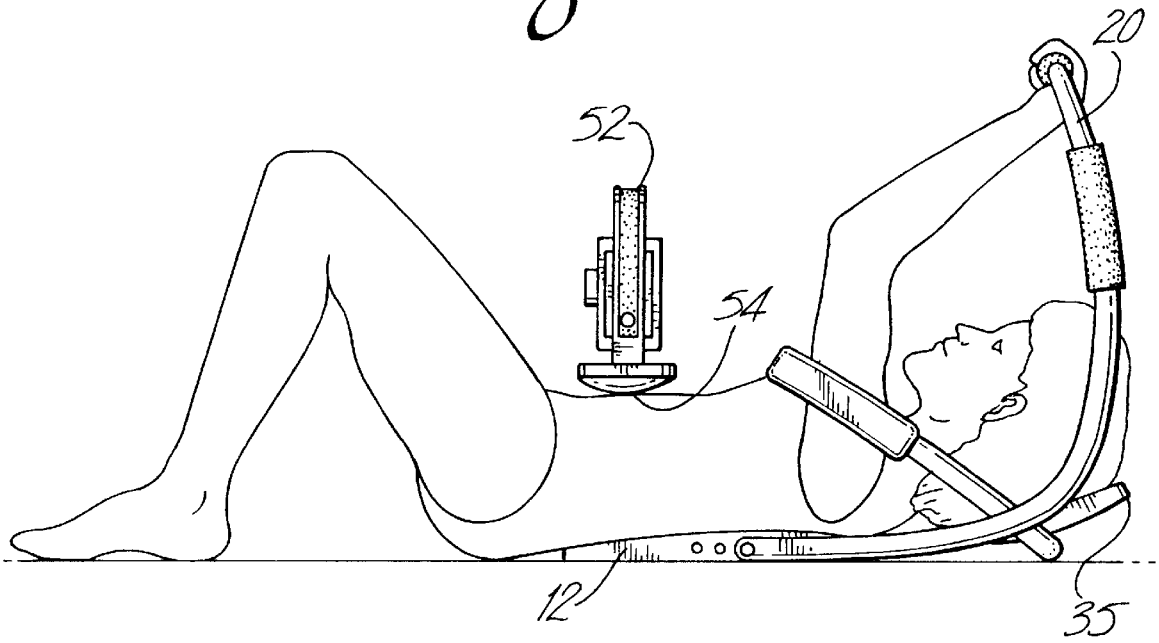
FIGS. 4*a* and 4*b* illustrate the operation of the present invention.
Figure 4B:
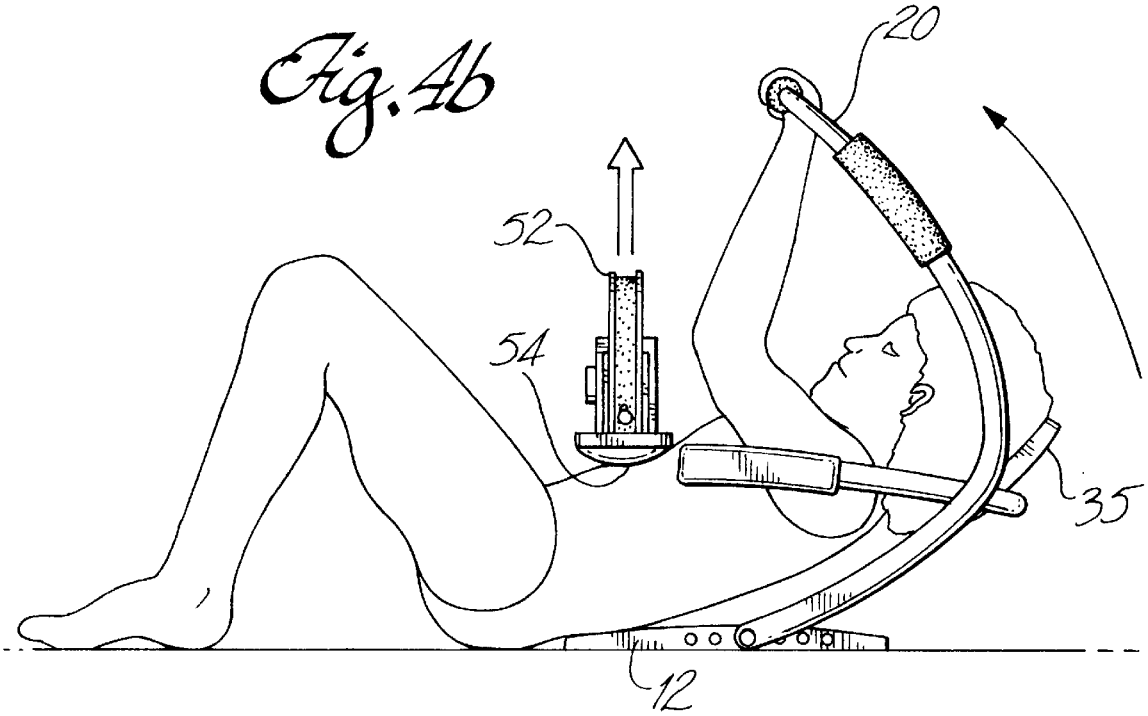
Figure 5:
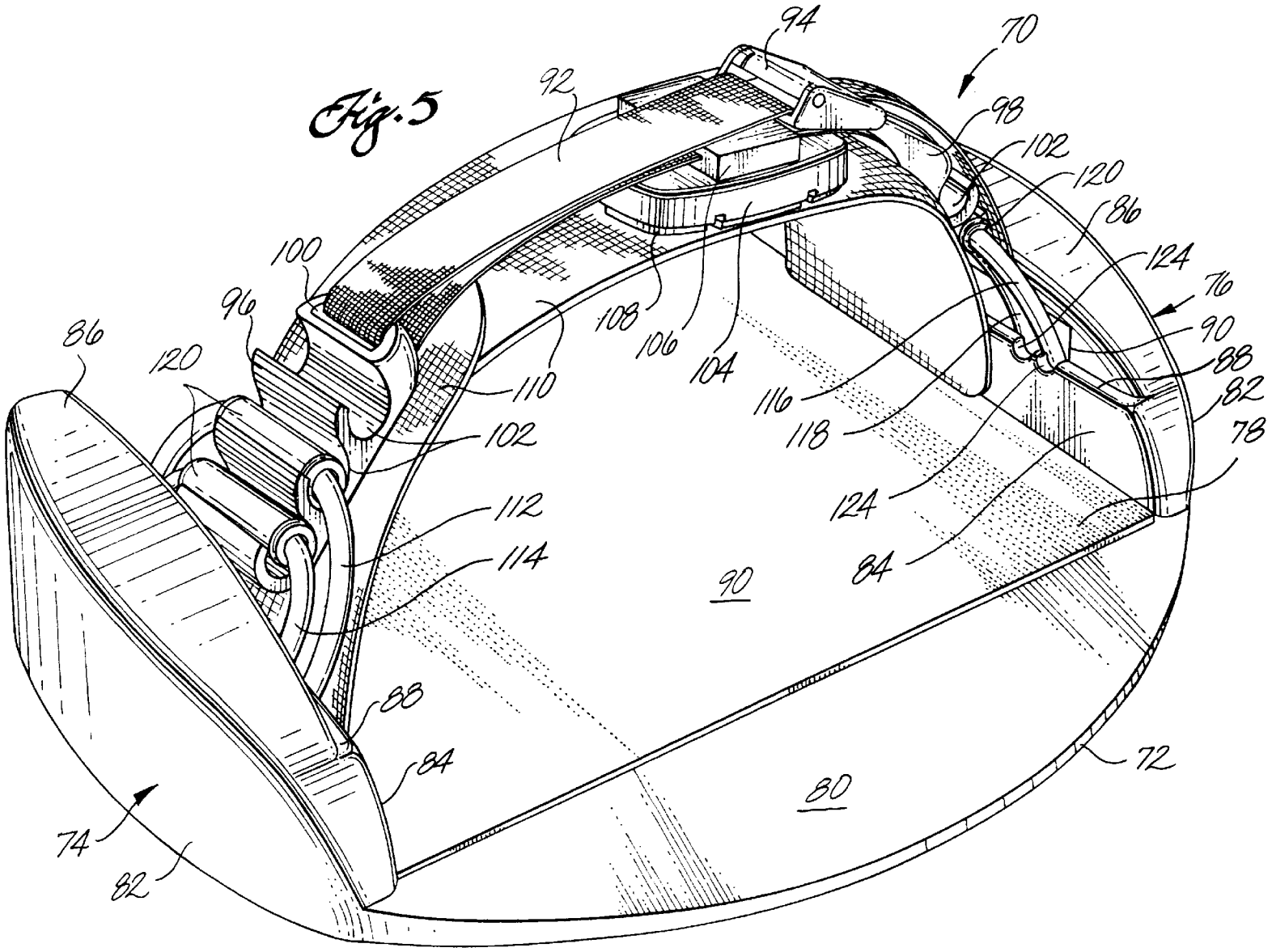
FIG. 5 is a perspective view of a first alternative and preferred abdominal exercise device of the present invention.
Figure 6:
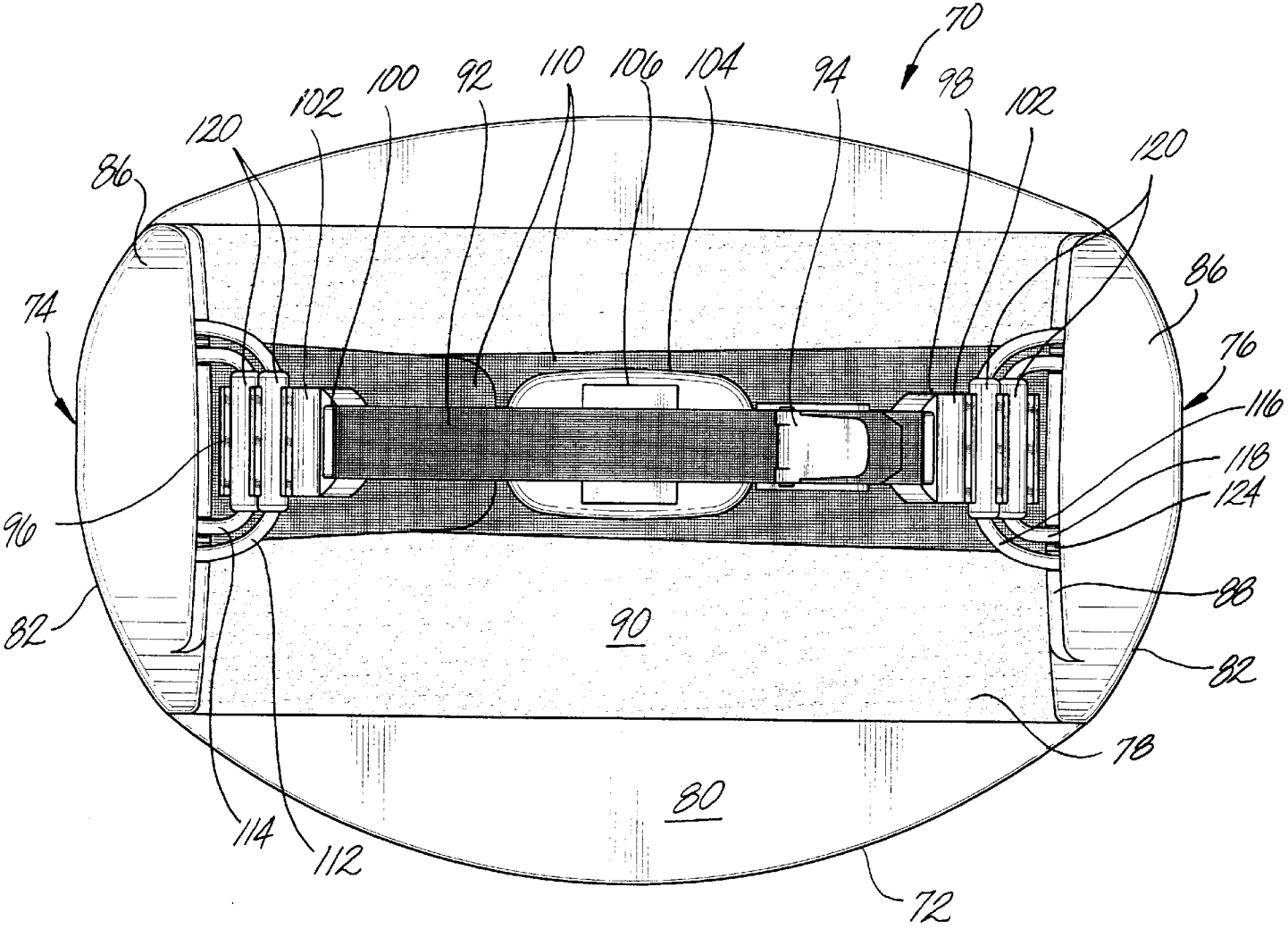
FIG. 6 is a top view of the device of FIG. 5.
Figure 7:
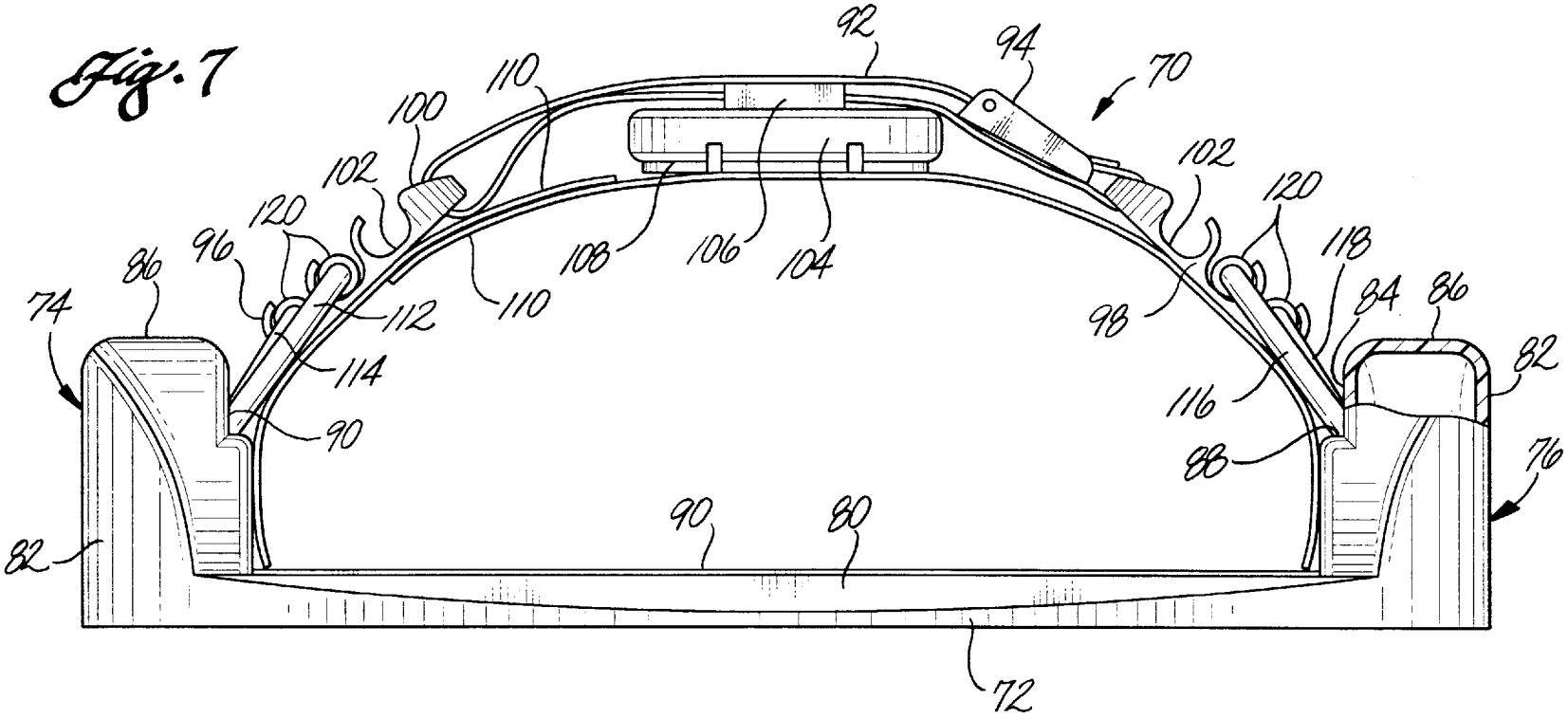
FIG. 7 is a front view of the device in FIG. 5 partially cut away.

FIGS. 4*a* and 4*b* illustrate the operation of the present invention. A user places his or her back on the platform 12, grips the cross member 20 and rests his or her head against the head rest 35. The vertical position of the plunger 52 is adjusted along the post 42 (FIG.2) or pole 60 (FIG.3) such that the pad 54 just touches the user's abdomen. From the substantially linear (lying down) position shown in FIG. 4*a*, the user rotates his or her upper body to the position shown in FIG. 4*b*, with the plunger 52 providing an increasing resistance as the user rotates his or her body. The direct resistance provides an isometric abdominal exercise and also resists the user's rotation, which enhances that rotating "crunch" type exercise.

FIGS. 5 through 8 illustrate an alternate and preferred abdominal exercise device 70 in accordance with the principles of the invention. Exercise device 70 comprises a platform 72 having upwardly extending sidewalls 74 and 76 which extend perpendicularly from a horizontal center section 78. Center section 78 has an angled front surface 80 sloping downwardly towards the ground level. The platform preferably is made from a polymeric material such as plastic however could be made from lightweight metal such as aluminum. Sidewalls 74 and 76 are hollow, having an outer wall 82 and an inner wall 84 connected by a top wall 86. Inner wall 84 has an intermediate ledge 88 and an opening 90 passing into the internal cavity of the sidewalls. The center section 78 of the platform is covered by a pad 90 preferably made of neoprene or other foam materials to provide a cushioning effect for the user of the exercise device.

Positioned between the side walls and over the center section of the platform is a resistive abdominal strap which includes an adjustable belt 92. Belt 92 is formed from a band having the ends overlapping to form a loop and includes a releasable clasp 94 at one end for adjusting the tightness of the belt. Positioned on one side of the belt is a first connector 96 and positioned on a second opposite side of the belt is a second connector 98. Connectors 96 and 98 include eyelets 100 for receipt of the belt. Each connector also includes a plurality of channels 102 for adjustably connecting the belt to the platform. Positioned below the clasp 94 on the belt is an abdominal pad 104. The abdominal pad is a generally rectangular pad including an upper portion 106 including a channel for receipt of the belt. Upper portion 106 secures the abdominal pad to the belt. Abdominal pad 104 is a rigid structure made of polymeric materials such as plastic. The abdominal pad includes a cushioned surface 108 opposite the upper portion 106 which comprises a neoprene or foam layer for the comfort of the user. In addition, the exercise apparatus includes a two piece overlapping abdominal sheet 110 for the comfort of the user positioned along the belt below the abdominal pad and extending from the inner wall 84 of sidewall 74 to the inner wall 84 of sidewall 76. Abdominal sheet 110 is held adjacent the adjustable belt by including hook and loop fasteners positioned between the top surface of the sheet and the bottom surface of connectors 96 and 98. Other methods of connecting abdominal sheet 110 to the adjustable belt could be through the use of other suitable fasteners such as glue, snaps, etc.

Figure 8:
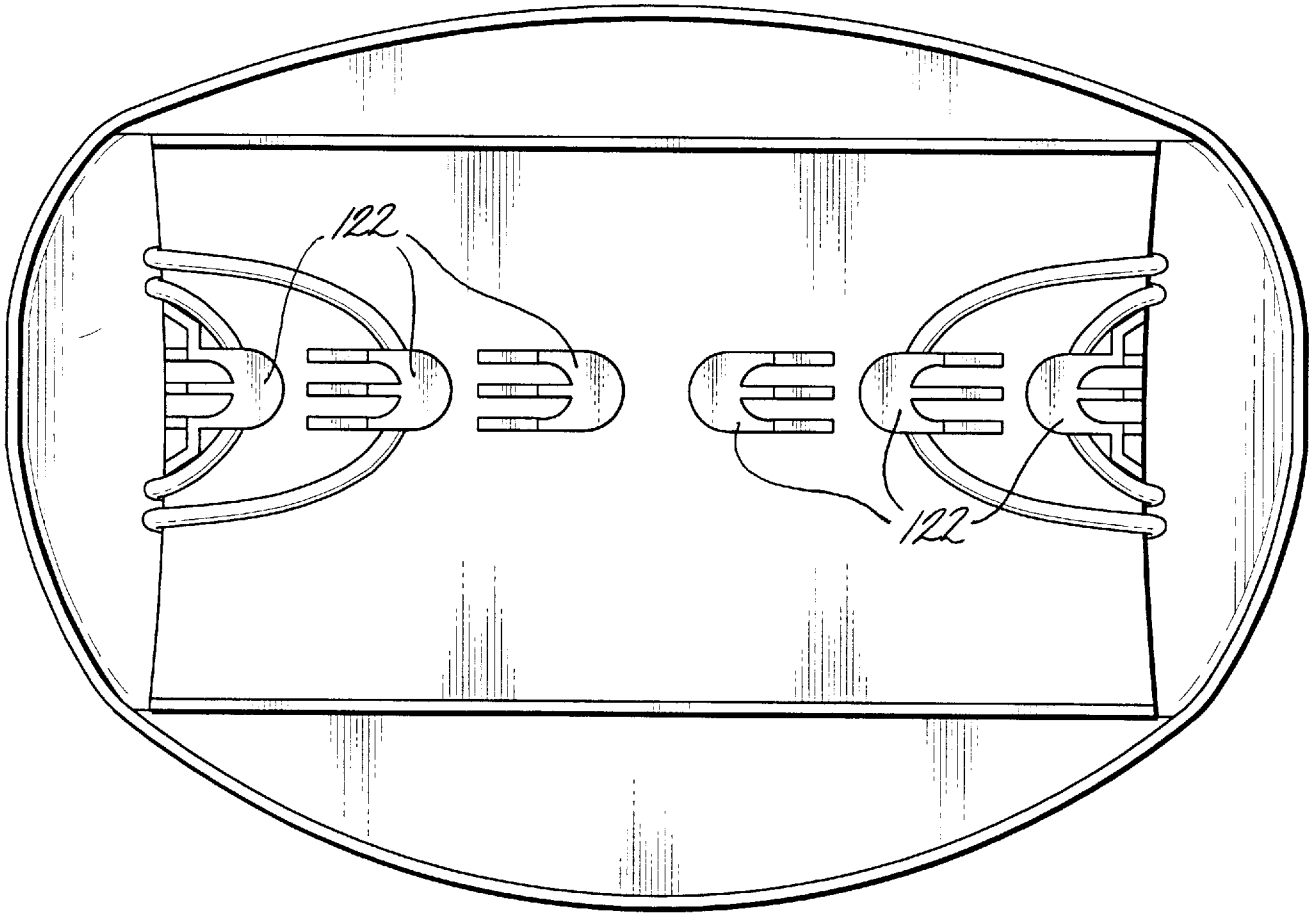
FIG. 8 is a bottom view of the device of FIG. 5.

The resistive abdominal strap further includes elastic cords 112 through 118 wherein the belt is connected to the platform by the elastic cords. Preferably two cords, one longer than the other, are positioned on either side of the belt however more or less cords could be utilized. Each elastic cord includes a cylindrical fastener 120 which snaps into channels 102 of connectors 96 and 98. Elastic cords 112 through 118 are a continuous loop which pass through the opening 90 in the sidewalls and extend underneath the platform and are secured to individual fastening hooks 122 extending downwardly from the bottom surface of the platform as shown in FIG. 8. A number of fastening hooks are available to adjust the tension in the elastic cords. The thickness, length and modulus of elasticity for each cord can be varied depending upon the desired resistance to be provided by the cords. The cylindrical fasteners 120 are color coded to designate the different resistance levels of the elastic cords. The intermediate ledges 88 in the inner walls 84 include dimples 124 for guiding the elastic cords into the cavity of the sidewalls. Besides the position of the cords, the tension in the elastic cords can also be adjusted by placing the cylindrical connectors 120 within the various channels 102 of connectors 96 and 98.

In use, the user opens the clasp 94 and opens the belt 92 and lays down across the center section of the platform 72 such that the abdominal sheet 110 and abdominal pad 104 are adjacent the abdomen. Initially, to accommodate the size of the user, the elastic cords are set by positioning the cylindrical connectors 120 in the desired channel 102 of connectors 96 and 98 and the opposite end of the elastic cord on the desired fastening hooks 122 on the bottom of the platform. The belt is then tightened to adjust the tension in the elastic cords as desired and the clasp is engaged to secure the belt across the user's abdomen. The user then rotates forward as in a "crunch" type exercise, thereby engaging the abdominal pad, which in combination with the elastic cords provide direct resistance to the abdomen. The platform is held adjacent to the ground by the weight of the user.

Figure 9:
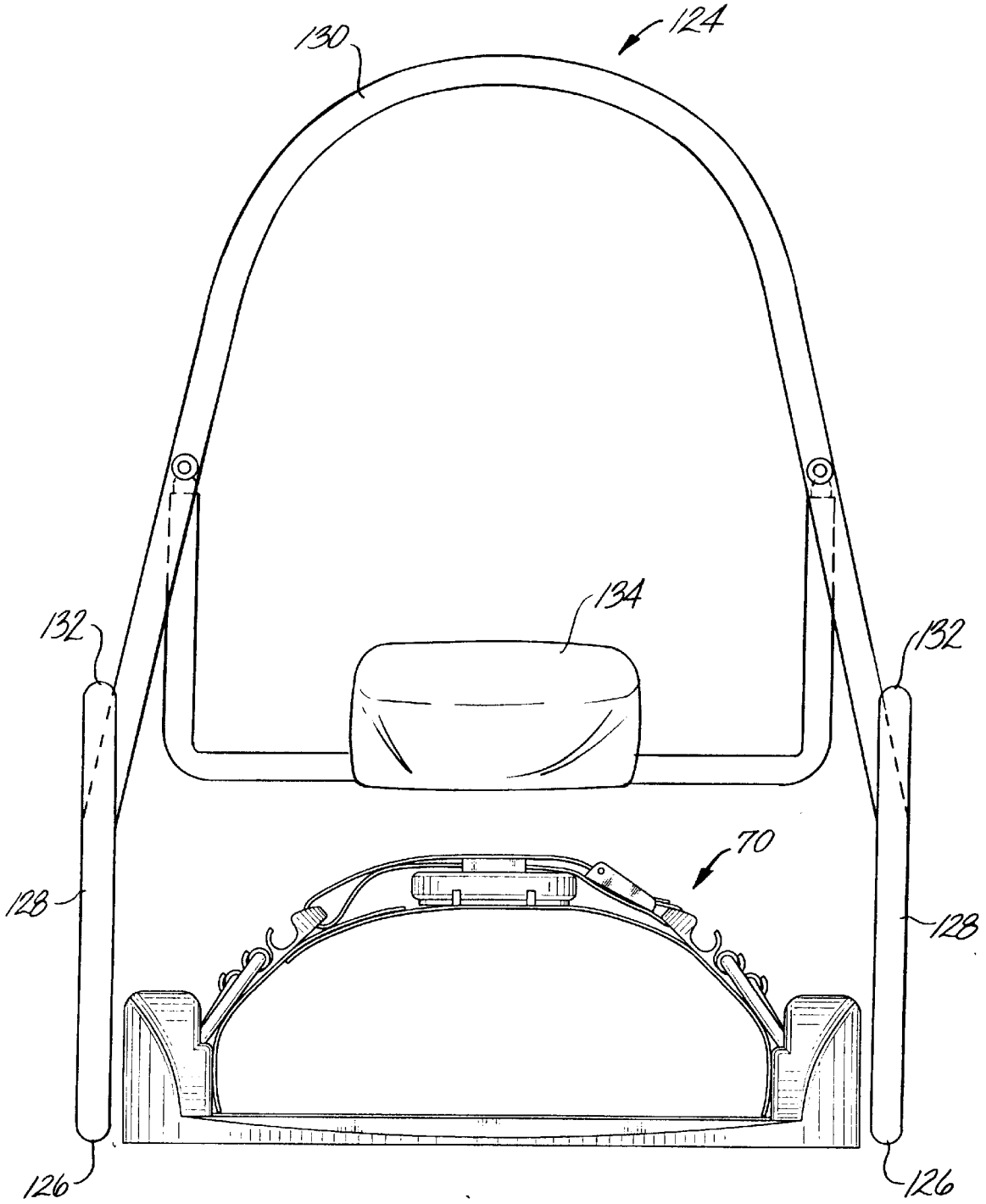
FIG. 9 is a front view of the device of FIG. 5 as used in combination with a roller type exercise device.
Figure 10:
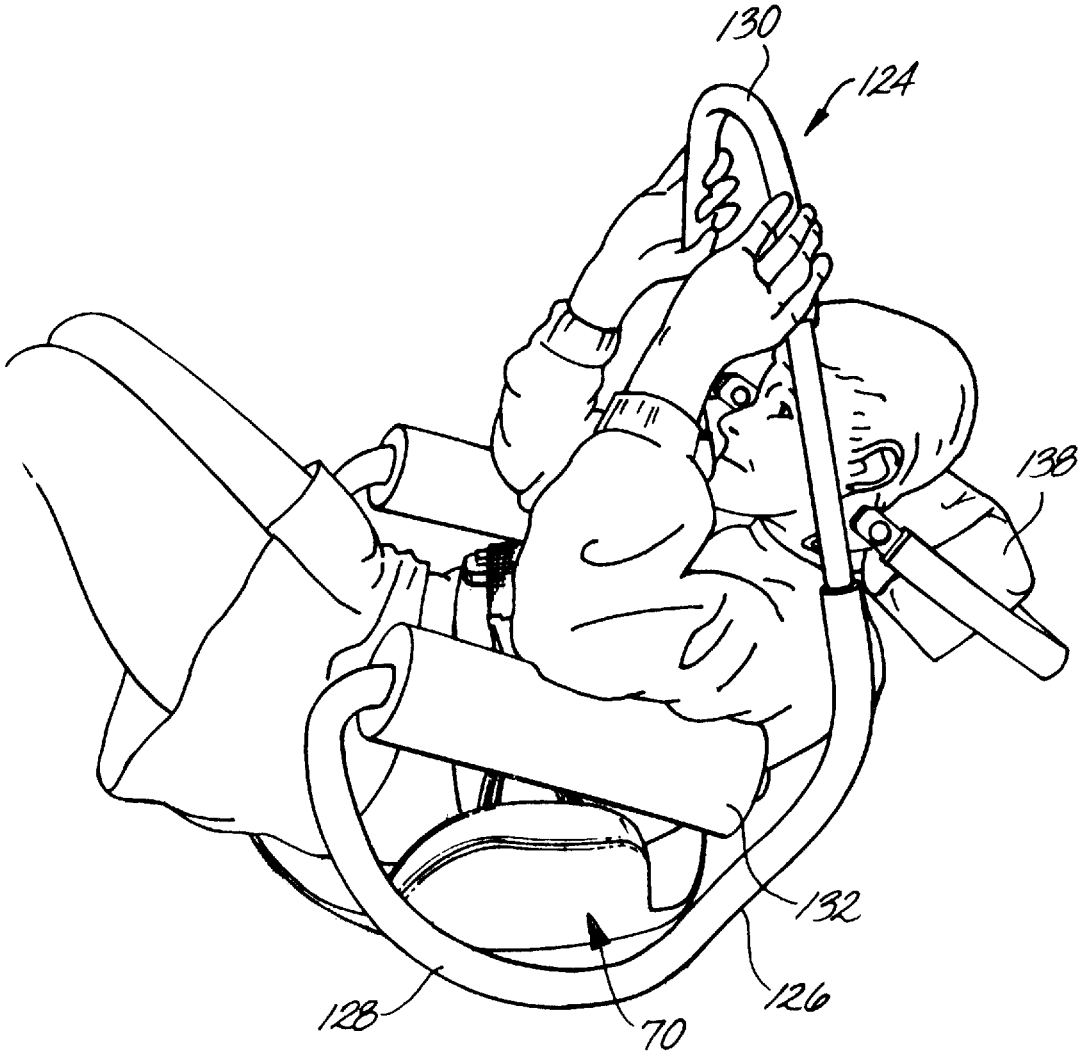
FIG. 10 is a side view of the combination of FIG. 9.

The exercise device 70 can also be used in combination with a "roller" type exercise device as disclosed in U.S. Pat. No. 5,492,520, the disclosure of which is incorporated herein by reference, and as depicted in FIGS. 9 and 10. The roller type device 124 comprises a frame defining a pair of support rails 126 extending between a rocker portion 128 and an arch shaped portion 130. The frame further includes a pair of arm rest portions 132 and a head rest portion 134, extending between the arch shaped portion 130. In use with the roller device 124, the abdominal exercise device 70 is positioned between the support rails so that the abdominal pad and elastic cords provide resistance against the abdomen as the user rotates forward with the roller device on the rocker portions 128. The device 70 provides an isometric abdominal exercise while enhancing the kinetic exercise of the roller device.

Although the present invention has been illustrated with respect to two embodiments thereof, the invention is not to be so limited since changes and modifications can be made that are within the full intended scope of this invention as hereinafter claimed.

What is claimed is:

1. An abdominal exercise device comprising:

a lower back platform;

an abdominal belt connected to the platform, the belt having at least one elastic portion for providing a continuous isometric or kinetic force toward the platform; and an abdominal pad positioned on the belt.

2. The exercise device of claim 1 wherein the belt further includes a connector positioned on the belt and having means for adjustably connecting the belt.

3. The exercise device of claim 2 wherein the means for adjustably connecting the belt comprises a plurality of channels in the connector for receipt of the elastic portion.

4. The exercise device of claim 1 wherein the platform includes a plurality of fastening hooks for connecting the elastic portion.

5. The exercise device of claim 4 wherein the fastening hooks are located on a bottom surface of the platform.

6. The exercise device of claim 1 wherein the platform includes a sidewall extending upwardly on opposite sides of the platform, each sidewall including an outer wall and an inner wall connected by a top wall thereby defining a cavity for passage of the elastic portion through an opening in the inner wall.

7. An exercise system comprising an abdominal roller exercise device and an abdominal exercise apparatus comprising a platform and an elastic abdominal belt extending over and adjustably attached to the platform for providing resistance to a user's abdomen.

8. The exercise system of claim 7 wherein the elastic belt includes an abdominal pad and at least one elastic section extending from each side of the belt and connected to the platform.

9. The exercise system of claim 8 wherein the belt further includes a connector positioned on opposite sides of the belt and having means for adjustably connecting the belt.

10. The exercise system of claim 9 wherein the means for adjustably connecting the the belt comprises a plurality of channels in the connector for receipt of the elastic section.

11. The exercise system of claim 8 wherein the platform includes a plurality of fastening hooks for adjusting the tension in the elastic section.

12. The exercise system of claim 11 wherein the fastening hooks are located on a bottom surface of the platform.

13. The exercise system of claim 8 wherein the platform includes a sidewall extending upwardly on opposite sides of the platform, each sidewall including an outer wall and an inner wall connected by a top wall thereby defining a cavity for passage of the elastic section through an opening in the inner wall.

14. An exercise system comprising:

an abdominal roller exercise device;

a separate abdominal exercise apparatus positioned below the abdominal roller exercise device comprising a platform and resistance means connected to the platform for engaging a user's abdomen to provide an isometric and kinetic force towards the platform.

15. The exercise system of claim 14 wherein the resistance means is an adjustable belt and at least one elastic cord extending from each side of the belt and attached to the platform.

16. The exercise system of claim 15 wherein the belt further includes a connector having means for adjustably connecting the elastic cord to the belt.

17. The exercise system of claim 16 wherein the means for adjustably connecting the elastic cord to the belt comprises a plurality of channels in the connector for receipt of the elastic cord.

18. The exercise system of claim 15 wherein the platform includes a plurality of fastening hooks positioned on a bottom surface of the platform for connecting the elastic section.

19. The exercise system of claim 2 wherein the elastic cord is color coded to designate different elasticities.

20. The exercise system of claim 8 wherein the elastic cord is color coded to designate different elasticities.

* * * * *